US011407249B2

(12) United States Patent
Ramsey

(10) Patent No.: US 11,407,249 B2
(45) Date of Patent: Aug. 9, 2022

(54) TAB PRESS AND METHOD OF MARKING INDICIA ON TAB STOCK

(71) Applicant: CROWN PACKAGING TECHNOLOGY, INC., Alsip, IL (US)

(72) Inventor: Chris Ramsey, Oxfordshire (GB)

(73) Assignee: CROWN PACKAGING TECHNOLOGY, INC., Alsip, IL (US)

( * ) Notice: Subject to any disclaimer, the term of this patent is extended or adjusted under 35 U.S.C. 154(b) by 0 days.

(21) Appl. No.: 17/291,293

(22) PCT Filed: Oct. 30, 2019

(86) PCT No.: PCT/GB2019/053077
§ 371 (c)(1),
(2) Date: May 5, 2021

(87) PCT Pub. No.: WO2020/099827
PCT Pub. Date: May 22, 2020

(65) Prior Publication Data

US 2021/0362537 A1 Nov. 25, 2021

(30) Foreign Application Priority Data

Nov. 12, 2018 (GB) ..... 1818387

(51) Int. Cl.
*B44C 1/24* (2006.01)
*B21D 51/38* (2006.01)
(Continued)

(52) U.S. Cl.
CPC ..... *B44C 1/24* (2013.01); *B21D 51/383* (2013.01); *B44B 5/0052* (2013.01); *B44B 5/026* (2013.01)

(58) Field of Classification Search
CPC ..... B44C 1/24; B21D 51/383; B44B 5/0052; B44B 5/026
See application file for complete search history.

(56) References Cited

U.S. PATENT DOCUMENTS 4,106,422 A * 8/1978 Buhrke ..... B21D 51/383 413/17
2006/0146442 A1 7/2006 Ser et al.
(Continued)

FOREIGN PATENT DOCUMENTS

FR 2915920 A1 11/2008
GB 938253 A 10/1963
(Continued)

OTHER PUBLICATIONS

International Search Report and Written Opinion issued in PCT/GB2019/053077, dated Jan. 30, 2020.
(Continued)

*Primary Examiner* — Peter J Macchiarolo
*Assistant Examiner* — John M Royston
(74) *Attorney, Agent, or Firm* — Condo Roccia Koptiw LLP

(57) ABSTRACT

A method of marking indicia on tab stock used to provide tabs for use with can ends. The method comprises providing the tab stock to a tab press comprising a punch and a die. The punch comprises a set of raised features and the die comprises a respective set of recessed features such that the features cooperate to deboss said indicia on regions of the tab stock within tab forming areas that face outwardly when the tabs are attached to a tab end. The features are such that, when the press is fully closed, the spacing between at least part of each of the raised features and at least part of each of the respective recessed features is less than the thickness of the tab stock in said regions within tab forming areas.

20 Claims, 3 Drawing Sheets

(51) Int. Cl.
*B44B 5/00* (2006.01)
*B44B 5/02* (2006.01)

(56) References Cited

U.S. PATENT DOCUMENTS

| | | | | |
|---|---|---|---|---|
| 2008/0078764 | A1* | 4/2008 | McEldowney .... | B65D 17/4012 220/269 |
| 2010/0193519 | A1 | 8/2010 | Forrest et al. | |
| 2018/0148219 | A1* | 5/2018 | Hundeloh ..... | B65D 17/404 |

FOREIGN PATENT DOCUMENTS

| | | | |
|---|---|---|---|
| JP | S53-149865 | A | 12/1978 |
| JP | S57-75875 | A | 5/1982 |
| WO | 2010100119 | A1 | 9/2010 |
| WO | WO 2012/164007 | A1 | 12/2012 |

OTHER PUBLICATIONS

International Preliminary Report on Patentability issued in PCT/GB2019/053077, dated Mar. 3, 2021.

* cited by examiner

PRIOR ART

TAB PRESS AND METHOD OF MARKING INDICIA ON TAB STOCK

CROSS-REFERENCE TO RELATED APPLICATIONS

This application is the National Stage of International Application No. PCT/GB2019/053077, filed Oct. 30, 2019, which claims the benefit of GB application number 1818387.1, filed Nov. 12, 2018, the disclosures of which are incorporated herein by reference in their entirety.

TECHNICAL FIELD

The present invention relates to a method of marking indicia on tab stock used to provide tabs for use with can ends, and a tab press for producing tabs marked with the indicia. In particular, but not exclusively, it relates to tabs featuring debossed indicia for use with beverage cans.

BACKGROUND

End closures for cans, such as beverage cans, typically have a panel with a frangible score which may be broken by lifting a tab in order to push a section of the panel into the can and thereby form an opening in the panel. FIG. 1 shows an example of a known tab 100 which has a nose 102, a lift end 104 opposite the nose 102 and a "rivet island" 106 close to the nose 104. The rivet island 106 is partially encircled by a horse shoe cut out 108 and has an aperture 109 for receiving a rivet (not shown) in order to attach the tab to the can end. Most tab designs have a cut out region (or "finger hole") with a curled rim between the horse shoe 108 and the lift end 104, which helps strengthen the tab so that it does not bend when the can is opened. However, in other designs, the cut out is omitted. This is the case with the tab 100 of FIG. 1 where the omission of the cut out results in a flat panel 110 between the horse shoe 108 and the lift end 104. It is known to mark tabs with flat panel for branding and promotional purposes or to communicate details regarding the contents of the can to the user.

Different approaches to marking tabs have been considered, including embossing, piercing, scoring, etching and colour printing. For example, US 2010/0193519 describes a tab marked with an embossed figure. The term embossing, as used in the present document, refers to forming a "raised" feature in a surface, such that the feature stands out from the surface.

Embossing typically does not allow complex designs to be applied to tabs for can ends because the minimum feature size that can be produced by embossing is relatively large in comparison to the area available on the tab. One difficulty is that the thickness of the tab material (generally around 0.25 mm) precludes the height of the embossed features above the surrounding surface from being too great, making the embossed features difficult to see clearly. Small gaps between features may also not be reproduced clearly, causing the features to merge into one another, which is a particular problem for lettering. More detailed designs can be produced by (for example) laser etching the surface of the tabs, but such techniques can be complicated to implement and time consuming (particularly when the designs are very detailed and therefore ill-suited to modern high-speed production methods.

There is therefore a need to provide a way of marking tabs which allows more detailed designs to be used and which can be easily integrated into existing manufacturing processes.

SUMMARY

According to a first aspect of the invention there is provided a method of marking indicia on tab stock used to provide tabs for use with can ends. The method comprises providing the tab stock to a tab press comprising a punch and a die. The punch comprises a set of raised features and the die comprises a respective set of recessed features such that the features cooperate to deboss said indicia on regions of the tab stock within tab forming areas that face outwardly when the tabs are attached to a tab end. The features are such that, when the press is fully closed, the spacing between at least part of each of the raised features and at least part of each of the respective recessed features is less than the thickness of the tab stock in said regions within tab forming areas.

The term debossing is used in this document to refer to the process of impressing a design into a surface so that the design is transferred to the surface as an indentation from the side viewed by a consumer. The indicia may, for example, include one or more of the following: characters, shapes, numbers, logos, patterns and/or graphic images.

Each of the features may comprise surfaces that are inclined relative to a plane of the punch and the die, and the parts of the raised and recessed features that have a spacing that is less than the thickness of the tab stock in the regions within tab forming areas may be provided by the inclined surfaces.

Each of the raised features of the punch may comprise a flat outer surface substantially parallel to the plane, each flat outer surface having an angular junction with one of the inclined surfaces.

The inclined surfaces of the recessed features of the die may have an angular junction with an outer face of the die. The spacing that is less than the thickness of the tab stock in the regions within tab forming areas may be a spacing between angular junctions of the raised and recessed features.

The spacing may be less than 80%, or less than 60%, of the thickness of the tab stock in the regions within tab forming areas.

The spacing may be greater than 20%, or greater than 40%, of the thickness of the tab stock in the regions within tab forming areas.

The press may be configured to press the raised surfaces of the punch into said regions of the tab stock by less that 70%, or less than 50%, of the thickness of the tab stock in the regions within tab forming areas.

The method may be performed prior to steps of drawing and curling rims of the tab forming areas.

The method may be performed prior to a step of piercing peripheries of the tab forming areas to form rims.

The method may be performed concurrently with a step of drawing rims extending around horseshoe cut outs formed in the tab forming areas.

The method may be performed concurrently with a step of forming rivet cut outs in the tab forming areas.

The indicia may comprise one or discrete features, such as alphanumeric characters, with a debossed feature dimension in the plane of the tab of less than 0.25 mm, preferably less than 0.15 mm.

Two or more of the raised features of the punch may differ in their maximum heights.

According to a second aspect of the invention there is provided a tab press configured to accept tab stock having a thickness of between 0.24 mm and 0.26 mm. The tab press is further configured to produce tabs marked with indicia and comprises a punch comprising a set of raised features and a die comprising a respective set of recessed features, such that the features cooperate to deboss said indicia on regions of the tab stock within tab forming areas that face outwardly when the tabs are attached to a tab end. The features are such that, when the press is fully closed, the spacing between at least part of each of the raised features and at least part of each of the respective recessed features is less than the thickness of the tab stock the tab press is configured to accept.

The spacing may be less than 0.20 mm, or less than 0.15 mm.

The tab press may comprise tooling for drawing and curling rims of tab forming areas of the tab stock and the tab press may be configured to deboss the indicia on the tab stock prior to drawing and curling the rims.

The tab press may comprise tooling for piercing peripheries of tab forming areas of the tab stock to form rims and the tab press may be configured to deboss the indicia on the tab stock prior to forming the rims.

The tab press may comprise tooling for drawing rims extending around horseshoe cut outs formed in tab forming areas of the tab stock and the tab press may be configured to deboss the indicia on the tab stock concurrently with forming the rims extending around the horseshoe cut outs.

The tab press may comprise tooling for forming rivet cut outs in the tab forming areas and the tab press may be configured to deboss the indicia on the tab stock concurrently with forming the rivet cut outs.

According to a third aspect of the invention, there is there is provided a can end having affixed thereto a tab comprising one or more debossed indicia which face outwardly from the can end such that they are visible to a consumer prior to opening.

The minimum debossed feature depth may be at least 0.05 mm or at least 0.10 mm. The tab may be formed from material which has a thickness of 0.24 to 0.26 mm.

The minimum debossed feature dimension in the plane of the tab may be less than 0.25 mm or less than 0.15 mm.

The indicia may comprise features debossed to different depths.

This third aspect may be entirely independent of the other aspects of the invention. For example, the tabs may not be formed using the method of marking indicia on tab stock described herein and may instead be formed using another method. Similarly, the tabs may be produced without using the tab press described herein and may instead be formed using another apparatus.

According to a fourth aspect of the invention, there is provided a tab for a can end. The tab comprises one or more debossed indicia, provided on a side of the tab which faces outwardly when the tab is attached to a can end.

The minimum debossed feature depth may be at least 0.05 mm or at least 0.10 mm. The tab may be formed from material which has a thickness of 0.24 to 0.26 mm.

The minimum debossed feature dimension in the plane of the tab may be less than 0.25 mm or less than 0.15 mm.

The indicia may comprise features debossed to different depths.

This fourth aspect may be entirely independent of the other aspects of the invention. For example, the tabs may not be formed using the method of marking indicia on tab stock described herein and may instead be formed using another method. Similarly, the tabs may be produced without using the tab press described herein and may instead be formed using another apparatus.

DETAILED DESCRIPTION

The embodiments that will now be described aim to address the above-mentioned problems by using a debossing process which is able to transfer indicia comprising a small minimum feature size on to a tab. The debossing process thereby allows tabs to be produced which feature detailed lettering, patterns or imagery. For example, using this debossing process it is possible to mark 0.25 mm thick tabs with lettering which has a minimum height of around 1 mm and which comprises letters with a characteristic line width of around 0.1 mm. Surprisingly, this level of detail can be achieved without damaging the material from which the tab is made. In particular, the method allows a "crisp" profile to be produced with only a small forming depth, thereby avoiding the tab material from being subjected to excessive strain during debossing.

Figure 1:
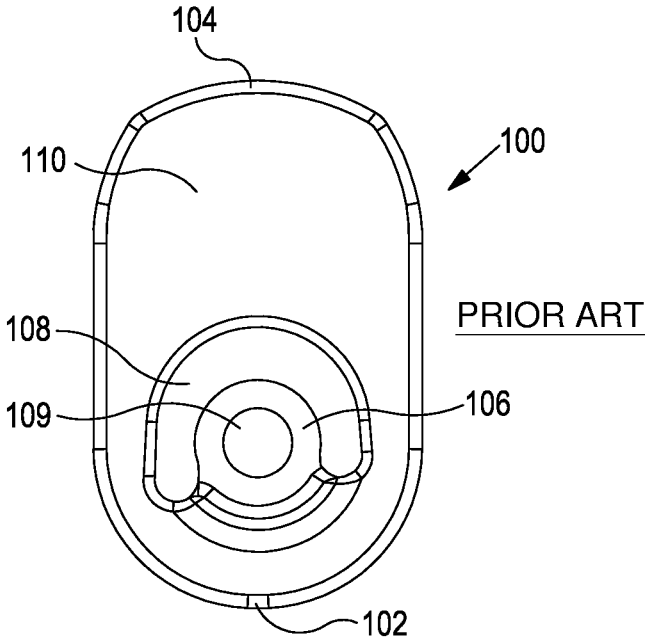
FIG. 1 is a schematic top view of a tab for a beverage can known in the prior art.
Figure 2A:
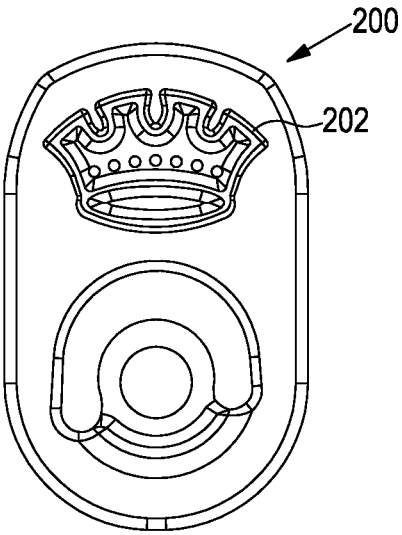
FIG. 2A is a schematic top view of a tab with a debossed image according to an embodiment of the invention.
Figure 2B:
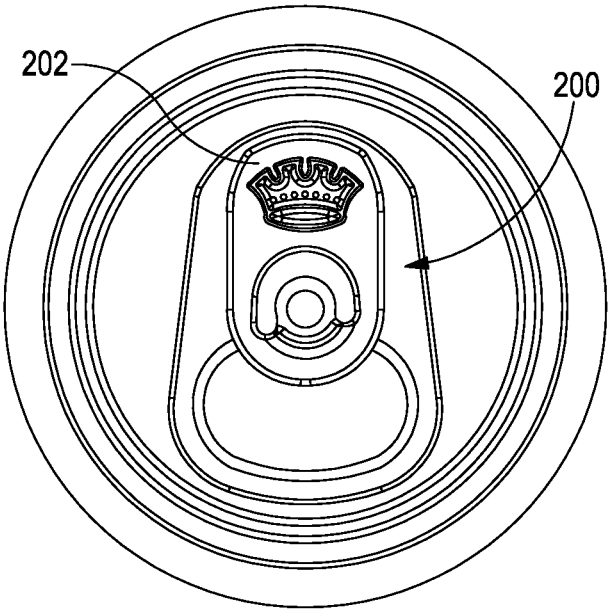
FIG. 2B is a schematic top view of a can end comprising the tab of FIG. 2A.

FIG. 2A shows an example of the type of design which can be provided according to the invention. In this case, tab 200 (which is similar to tab 100 in terms of its overall structure) is provided with a debossed image 202 of a crown. FIG. 2B illustrates the tab 200 affixed to a can end prior to seaming of the can end to a can body.

The tabs are made using a tab press which acts on tab stock to form the various features of the tabs. The tab stock output from the tab press is fed directly into a conversion press where tabs are pressed out of the tab stock and riveted to can ends, which are then subsequently seamed on to can bodies.

Figure 3:
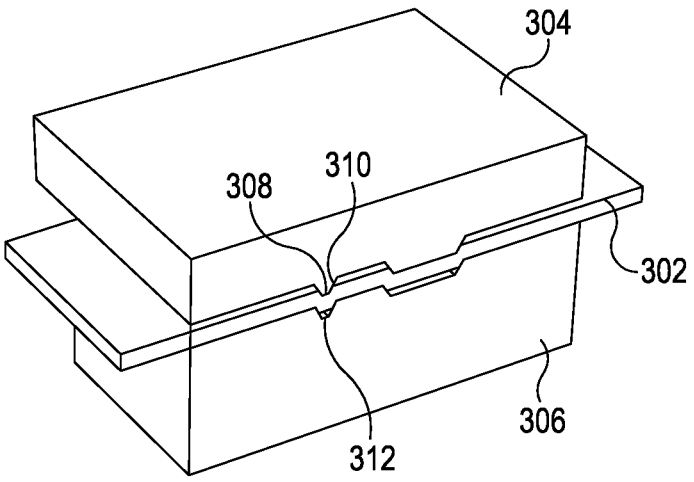
FIG. 3 is a schematic perspective view of a punch and die for debossing an image into sheet metal according to an embodiment of the invention.

FIG. 3 illustrates a cross-section through a small region 302 of a long metal sheet that forms the tab stock and which is located between a punch 304 and a die 306 which are incorporated into the tab press to mark the tab stock during tab production. In particular the figure illustrates in cross-section certain raised and recessed features of the punch and the die. The tab stock material is generally 5000 series aluminium with a gauge (thickness) of 0.24 to 0.27 mm.

Figure 4:
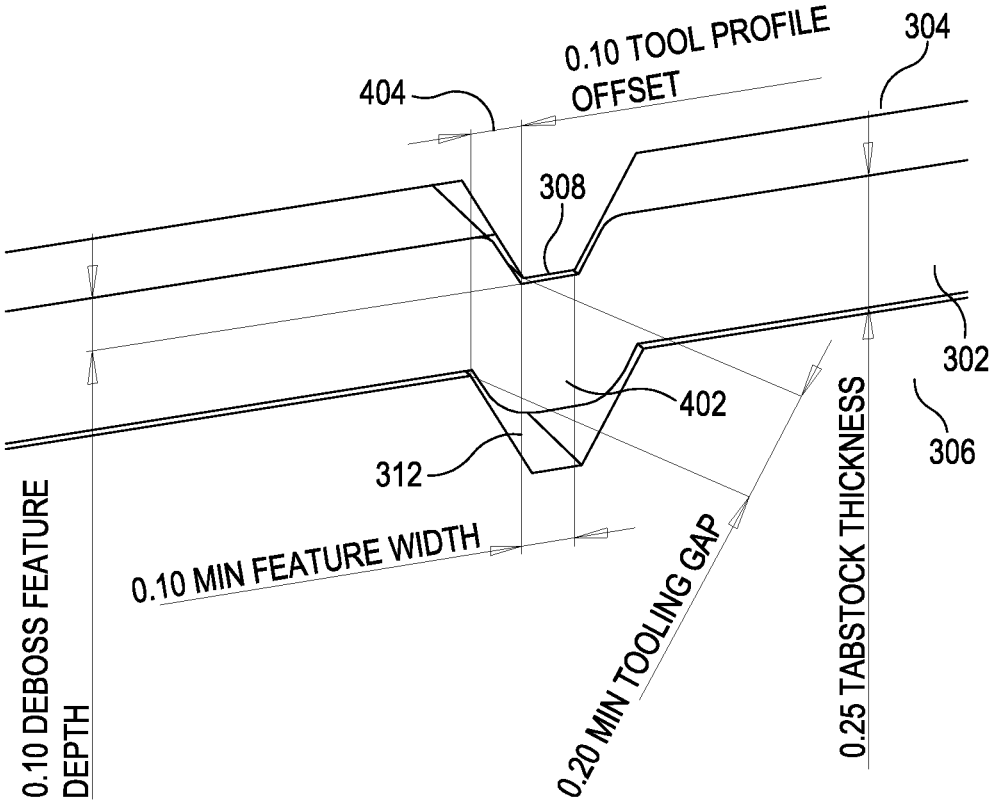
FIG. 4 is a an enlarged view of a portion of the punch and die shown in FIG. 3.

The surface of the punch 304 facing the metal sheet 302 is generally flat but has flat-topped ridges 308 projecting from it which defines the shapes of an indicia or markings, such as letters or symbols, which are to be impressed into the metal sheet 302. The indicia have a cross-section which is an isosceles trapezoid, with a base edge of the trapezoid defining the flat ridge 308, as can be more easily seen in the close up view shown in FIG. 4. The legs of the trapezoid define sidewalls on either side of the flat ridge 308 which are inclined outwardly from the flat ridge 308. This inclination helps avoid damaging the metal sheet 302 during pressing and also facilitates withdrawal of the punch.

The die 306 has a generally flat surface with channels or recesses 312 which are aligned with the flat ridges 308 and have a complementary shape and profile to them, such that the punch 304 and die 306 cooperate with one another in a male-female relationship. In this example, the recesses are also trapezoidal in cross-section such that they are wider at the top than the bottom. The punch 304 and die 306 are made from hardened and coated tool steel or carbide, although other suitably hard wearing materials can also be used. It will be appreciated that all side surfaces of the raised and recessed features may have a similar inclination with respect to the planes of the die and punch.

In operation, the punch 304 and die 306 are forced together to a fully closed position (where "fully" closed indicates the maximum extent of closure of the press) to deform the metal sheet 302 such that the markings or indicia defined by the ridges 308 are debossed into the upper surface of the metal sheet. A bulge or protrusion 402 is produced on the lower surface of the metal sheet which is accommodated in the recess 312. The width across the opening (i.e. top) of the recess 312 is larger than the width of the corresponding flat ridge 308 in order to provide clearance for the protrusion 402.

Figure 5:
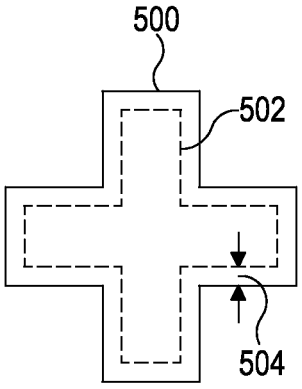
FIG. 5 is a schematic top view of a recess in a die.

FIG. 5 shows in solid line the outer perimeter 500 of an exemplary "+" shaped recess in a die, i.e. the periphery of the opening into the recessed feature, together with an outline in broken lines of the perimeter 502 of the flat outer region of the raised feature of the punch. The spacing between the two perimeters 500, 502 defines an "offset" distance or spacing 504 which is approximately constant around the entire perimeter.

Returning to FIG. 4, the offset distance 404 is indicated here as the horizontal distance (measured in the plane of the die) between the flat edge 308 of the punch 304 and the outer edge of the recess 312. It will be appreciated that the offset distance 404 affects how the tab stock is deformed under the shear force generated during operation of the press. Generally, in conventional embossing and debossing techniques for features of relatively small dimensions, the die recesses are machined to have offset distances which are larger than the thickness of the metal sheet in order to provide sufficient clearance to allow the metal sheet to bend into the desired shape without generating excessive strain in the material. However, in the die 306 of FIGS. 3 and 4 the offset distance 404 is chosen to be 0.10 mm, whereas the thickness of the metal sheet 302 is 0.25 mm, i.e. the offset distance 404 is less than the thickness of the metal sheet 302. It has been found, surprisingly, that using this smaller offset distance produces debossed features with better definition because the metal sheet 302 is compressed into the recess 312 through a gap between the raised surface 308 and the die 306 which is less than its thickness. In this example, this "minimum tooling gap" is 0.2 mm.

This process is similar to the initial stages of incising, in which a score tool is pressed into the one side of the material whilst the other side is supported by a flat anvil. However, in the debossing process described here, the die does not fully support the underside of the material, allowing it to deform into the recess, and the material is not fully sheared as the feature depth (i.e. the penetration depth of the punch 304 into the metal sheet) is only 0.1 mm. The debossing process employed here might be considered to involve a partial "coining" as a plastic flow is induced in the material in the horizontal gap between the punch and the die. It should be noted that process of marking indicia onto a tab using a fully coining process would be unsuitable as it is likely to damage coatings on the metal surface.

It has also been found that the debossing process absorbs slack material from the panel and thus improves the flatness of the tabs. This is important because the tabs are fixed to can ends which are stacked prior to being fed into a seamer (for sealing the end to a can body) and "wavy" tabs may lead to handling problems which disrupt the production line, for example the feeding of the ends into the seamer. Tabs with debossed features may also be preferred (over embossed features, for example) because forming the features as indentations in the upper tab surface reduces the risk of "scuffing" when can ends are stacked in sleeves for distribution. Additionally, as the debossing process does not require a change in colour of the tab material it is well suited to both coloured and plain tab materials and is more robust against rough handling. Any scuffing would remove the coating from the edges of the embossed features.

The raised surfaces 308 of the punch 304 may extend to different heights above the surface of the punch 304 so that features of differing depth may be created. This allows more detailed "three dimensional" images to be created even within the small area available on the tab, particularly as the debossing process allows even small features to be accurately reproduced.

In general, the tab press comprises a "production line" of tooling through which the tab stock is advanced in a stepwise fashion in order to progressively build up the features of the tab. As the tooling is applied to adjacent regions of the tab stock simultaneously, the different manufacturing stages are carried out in parallel with one another. The tooling is also typically replicated so that there are multiple, parallel rows of tabs being produced concurrently, which further allows the production rate to be increased. For example, a tab press may typically have 3-4 lanes, allowing around 750 tabs to be produced every minute. The dwell time between the tooling stages is typically around 50 ms.

Figure 6:
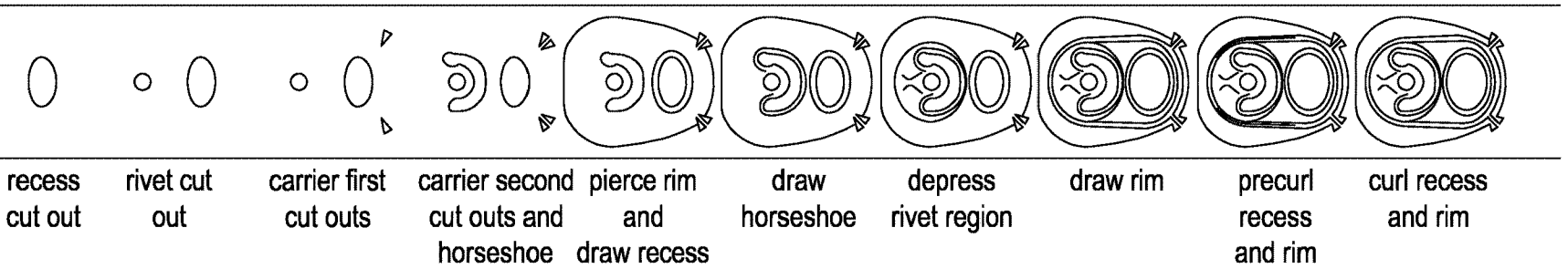
FIG. 6 is a schematic top view showing progress of tab stock in a tab press known in the prior art.

FIG. 6 shows a "snapshot" of the tab stock in a conventional tab press. The formation of a tab can be followed from left to right across the figure with the following stages:

a) Recess cut out
b) Rivet cut out
c) First carrier cut outs
d) Second carrier cut outs
e) Pierce rim and draw recess
f) Draw horseshoe
g) Depress rivet region
h) Draw rim
i) Pre-curl recess and rim
j) Curl recess and rim This process does not produce tabs with a flat panel because a recess is cut out of the tab stock in the first stage (a). However, when forming tabs which do have a flat panel, the tooling for cutting out the recess can be omitted, which provides space within the tab press tooling which can be used to accommodate the die and punch. This means that tab presses which are used for producing tabs which have a finger hole can be easily adapted to produce "flat panel" type tabs with embossed or debossed features.

Figure 7:
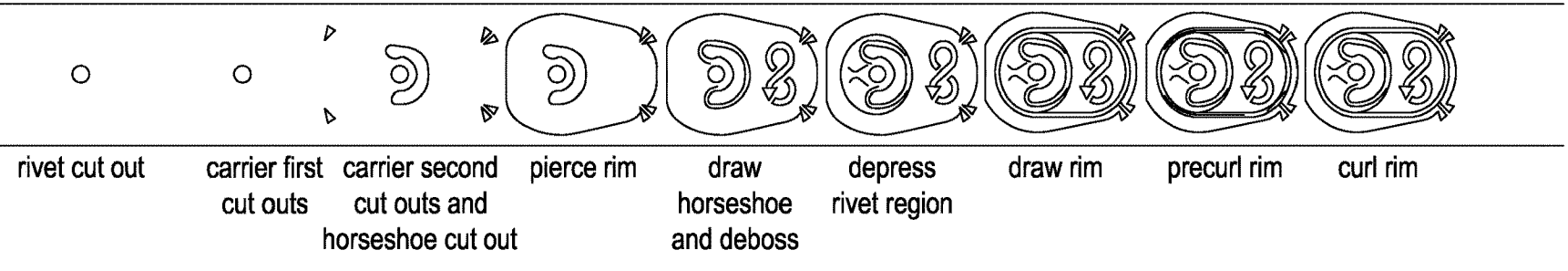
FIG. 7 is a schematic top view showing progress of tab stock in a tab press according to an embodiment of the invention.
Figure 8:
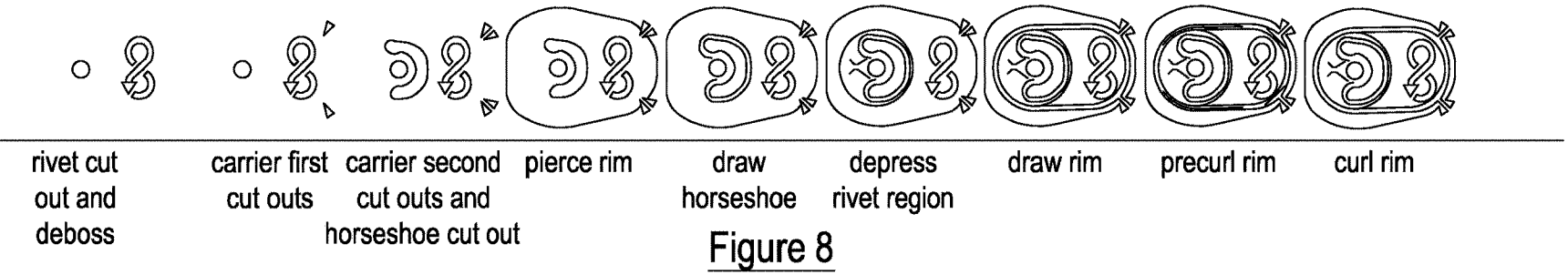
FIG. 8 is a schematic top view showing progress of tab stock in a tab press according to an alternative embodiment of the invention.

To illustrate the method of marking indicia during tab production, FIGS. 7 and 8 show tab stock which has been provided to a tab press comprising the punch and the die described above.

FIG. 7 is similar to FIG. 6, except that the tooling for stage (a) is omitted from the tab press, so that a tab with a flat panel is produced (with consequential changes to the tooling for the final pre-curling and curling stages), and tooling for a "deboss" stage is incorporated into the horse shoe drawing stage. In this example, the "flat panel" region of the tab stock is debossed with an infinity-symbol shaped logo and lettering at the same time as the horse shoe is drawn. It is preferable to perform debossing prior to curling of the rim as this maximises the area over which the indicia can be printed, i.e. the deboss die needs to extend around 0.3 mm beyond the periphery of the indicia, below the flat tab stock, and this space on the tab stock is consumed after the rim is curled.

FIG. 8 is similar to FIG. 6, except that the debossing stage is incorporated into the "rivet cut out" stage rather than the horseshoe drawing stage. It is generally preferable for the rivet cut out to be formed at either the same time or before the debossing stage because it can be used to help align the tab stock with respect to the subsequent tooling. Carrying out the debossing stage before the rim is pierced is preferable because, once the tab stock is pierced, material may be drawn inwards by the debossing process, creating a warped upper surface, or even breaking the carriers which retain the partially formed tab within the tab stock.

The debossed features can be enhanced using a laser process such as laser etching. For example, the general features of a design (e.g. an image of a face) may be debossed in the surface of the tab and fine details (e.g. details relating to the mouth and eyes) can be added by etching away material by laser ablation. As the laser etching is only used to provide the fine details, it is not necessary to have long process times which might otherwise limit the rate at which the tab production line operates. Laser etching is preferably performed during the dwell time of the tab stock as the tab stock exits the tab press and before it enters the conversion press.

It will be understood by the person of skill in the art that various modifications may be made to the above described embodiments without departing from the scope of the present invention. For example, the debossing technique could also be applied to transfer indicia to other parts of a can end or can body. Additionally, the die and press could be incorporated into or between any of the stages in the tab press or the tab stock could be marked with the indicia prior to entering the tab press.

The invention claimed is:

1. A method of marking indicia on tab stock used to provide tabs for use with can ends, the method comprising:

providing the tab stock to a tab press comprising a punch and a die, the punch comprising a set of raised features and the die comprising a respective set of recessed features such that the features cooperate to deboss said indicia on regions of the tab stock within tab forming areas that face outwardly when the tabs are attached to a tab end, said features being such that, when the press is fully closed, a spacing between at least part of each of the raised features and at least part of each of the respective recessed features is less than the thickness of the tab stock in said regions within tab forming areas.

2. The method according to claim 1, wherein each of said features comprises surfaces that are inclined relative to a plane of the punch and the die, and said parts of the raised and recessed features that have a spacing that is less than the thickness of the tab stock in said regions within tab forming areas are provided by the inclined surfaces.

3. The method according to claim 2, wherein each said raised feature of the punch comprises a flat outer surface substantially parallel to said plane, each flat outer surface having an angular junction with one of said inclined surfaces.

4. The method according to claim 3, wherein inclined surfaces of the recessed features of the die have an angular junction with an outer face of the die.

5. The method according to claim 4, wherein said spacing is a spacing between angular junctions of the raised and recessed features.

6. The method according to claim 1, wherein said spacing is less than 80% of the thickness of the tab stock in said regions within tab forming areas.

7. The method according to claim 1, wherein said spacing is greater than 20% of the thickness of the tab stock in said regions within tab forming areas.

8. The method according to claim 1, wherein the press is configured to press the raised surfaces of the punch into said regions of the tab stock by less than 70% of the thickness of the tab stock in said regions within tab forming areas when the press is fully closed.

9. The method according to claim 1 and comprising performing the method prior to steps of drawing and curling rims of the tab forming areas.

10. The method according to claim 9 and comprising performing the method prior to a step of piercing peripheries of the tab forming areas to form rims.

11. The method according to claim 9 and comprising performing the method concurrently with a step of drawing rims extending around horseshoe cut outs formed in the tab forming areas.

12. The method according to claim 10 and comprising performing the method concurrently with a step of forming rivet cut outs in the tab forming areas.

13. The method according to claim 1, wherein the indicia comprise one or more discrete features, such as alphanumeric characters, with a debossed feature dimension in the plane of the tab of less than 0.25 mm.

14. The method according to claim 1, wherein two or more of the raised features of the punch differ in their maximum heights.

15. A tab press configured to accept tab stock having a thickness of between 0.24 mm and 0.26 mm and further configured to produce tabs marked with indicia, comprising:

a punch comprising a set of raised features and a die comprising a respective set of recessed features such that the features cooperate to deboss said indicia on regions of the tab stock within tab forming areas that face outwardly when the tabs are attached to a tab end, said features being such that, when the press is fully closed, a spacing between at least part of each of the raised features and at least part of each of the respective recessed features is less than the thickness of the tab stock the tab press is configured to accept.

16. A tab press according to claim 15, wherein said spacing is less than 0.20 mm.

17. The tab press according to claim 15 and comprising tooling for drawing and curling rims of tab forming areas of the tab stock, the tab press being configured to deboss said indicia on the tab stock prior to drawing and curling said rims.

18. The tab press according to claim 17 and comprising tooling for piercing peripheries of tab forming areas of the tab stock to form rims, the tab press being configured to deboss said indicia on the tab stock prior to forming said rims.

19. The tab press according to claim 17 and comprising tooling for drawing rims extending around horseshoe cut outs formed in tab forming areas of the tab stock, the tab press being configured to deboss said indicia on the tab stock concurrently with forming said rims extending around the horseshoe cut outs.

20. The tab press according to claim 18 and comprising tooling for forming rivet cut outs in the tab forming areas, the tab press being configured to deboss said indicia on the tab stock concurrently with forming the rivet cut outs.

* * * * *